US012331979B2

(12) United States Patent
Yoon et al.

(10) Patent No.: US 12,331,979 B2
(45) Date of Patent: Jun. 17, 2025

(54) WATER SUPPLY APPARATUS AND REFRIGERATOR COMPRISING SAME

(71) Applicant: SAMSUNG ELECTRONICS CO., LTD., Suwon-Si (KR)

(72) Inventors: Seokjun Yoon, Suwon-si (KR); Jaekoog An, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 505 days.

(21) Appl. No.: 17/285,024

(22) PCT Filed: Dec. 16, 2019

(86) PCT No.: PCT/KR2019/017811
§ 371 (c)(1),
(2) Date: Apr. 13, 2021

(87) PCT Pub. No.: WO2020/138804
PCT Pub. Date: Jul. 2, 2020

(65) Prior Publication Data

US 2021/0341207 A1 Nov. 4, 2021

(30) Foreign Application Priority Data

Dec. 27, 2018 (KR) ..... 10-2018-0171150

(51) Int. Cl.
*F25C 1/25* (2018.01)
*F25D 23/12* (2006.01)

(52) U.S. Cl.
CPC ..... *F25C 1/25* (2018.01); *F25D 23/12* (2013.01); *F25C 2400/10* (2013.01); *F25C 2400/14* (2013.01); *F25D 2323/122* (2013.01)

(58) Field of Classification Search
CPC .... F25C 1/25; F25C 2400/10; F25C 2700/04; F25C 2500/06; F25D 2323/122
See application file for complete search history.

(56) References Cited

U.S. PATENT DOCUMENTS 4,903,505 A * 2/1990 Sakai ..... F25C 1/12 62/347
5,291,747 A * 3/1994 Sakai ..... F25C 1/12 62/135

(Continued)

FOREIGN PATENT DOCUMENTS

JP 7-159011 A 6/1995
JP 9-152242 A 6/1997

(Continued)

OTHER PUBLICATIONS

JP-H1194412-A English Translation (Year: 1997).*

(Continued)

*Primary Examiner* — David J Teitelbaum
*Assistant Examiner* — Devon Moore
(74) *Attorney, Agent, or Firm* — STAAS & HALSEY LLP

(57) ABSTRACT

A refrigerator according to the present disclosure comprises: an ice-making apparatus that is disposed in a freezer chamber and produces ice; a water tank that is disposed in a refrigerating chamber formed above the freezer chamber and stores water to be supplied to the ice-making apparatus; a water supply pipe that connects the water tank and the ice-making apparatus to supply water from the water tank to the ice-making apparatus; a water supply pump provided in the water supply pipe to move the water in the water tank to the ice-making apparatus; and a bypass pipe of which one side diverges from the water supply pipe to the opposite direction of gravity and the other side is connected to the water tank so that water flowing back from the water supply pipe moves to the water tank.

7 Claims, 6 Drawing Sheets

(56) References Cited

U.S. PATENT DOCUMENTS

| | | | | |
|---|---|---|---|---|
| 8,844,312 | B2 * | 9/2014 | Yoshida | F25C 1/25 62/348 |
| 2010/0101244 | A1 | 4/2010 | Yoshida et al. | |

FOREIGN PATENT DOCUMENTS

| | | | | | |
|---|---|---|---|---|---|
| JP | H1194412 | A | * | 9/1997 | F25C 1/12 |
| JP | 2000-220928 | A | | 8/2000 | |
| JP | 2000-292041 | A | | 10/2000 | |
| JP | 2001-183040 | A | | 7/2001 | |
| JP | 3315236 | B2 | | 8/2002 | |
| JP | 2009-2607 | | | 1/2009 | |
| KR | 10-0272365 | B1 | | 11/2000 | |
| KR | 10-0777300 | B1 | | 11/2007 | |
| KR | 10-2008-0103858 | A | | 11/2008 | |
| KR | 10-2010-0085690 | A | | 7/2010 | |
| KR | 10-1069963 | B1 | | 10/2011 | |
| KR | 10-1213914 | B1 | | 12/2012 | |
| KR | 10-1331948 | B1 | | 11/2013 | |
| WO | WO-2017036557 | A1 | * | 3/2017 | F25C 1/24 |

OTHER PUBLICATIONS

International Search Report dated Apr. 17, 2020, in corresponding International Patent Application No. PCT/KR2019/017811.

Written Opinion of International Searching Authority dated Apr. 17, 2020, in corresponding International Patent Application No. PCT/KR2019/017811.

Office Action dated Mar. 28, 2024, in Korean Patent Application No. 10-2018-0171150.

Office Action dated Nov. 1, 2024, in Korean Application No. 10-2018-0171150.

* cited by examiner

WATER SUPPLY APPARATUS AND REFRIGERATOR COMPRISING SAME

CROSS-REFERENCE TO RELATED APPLICATIONS

This application is a U.S. National Stage Application which claims the benefit under 35 U.S.C. § 371 of International Patent Application No. PCT/KR2019/017811 filed on Dec. 16, 2019, which claims foreign priority benefit under 35 U.S.C. § 119 of Korean Patent Application 10-2018-0171150 filed on Dec. 27, 2018, in the Korean Intellectual Property Office, the contents of both of which are incorporated herein by reference.

TECHNICAL FIELD

The disclosure relates to a water supply apparatus and a refrigerator comprising the same, and more particularly, to a water supply apparatus disposed in a refrigerating chamber and supplying water to an ice-making apparatus, and a refrigerator comprising the same.

BACKGROUND ART

In general, a refrigerator is a device that stores food fresh by including a storage space storing food and a cold air supply apparatus producing cold air through a refrigeration cycle and supplying the cold air to the storage space.

Based on a user's request, the refrigerator may include an ice-making apparatus producing ice. In order to operate such an ice-making apparatus, the refrigerator is required to include a water supply apparatus supplying water to the ice-making apparatus.

In general, in case of a French door refrigerator (FDR) type refrigerator having a refrigerating chamber on its upper side and a freezer chamber on its lower side, a water tank of the water supply apparatus may be installed in the refrigerating chamber and the ice-making apparatus disposed below the water tank may be installed in a freezer chamber. The water tank and the ice-making apparatus may be connected to each other by a water supply pipe including a water supply pump.

Water remaining in the water supply pipe may be frozen due to cold air introduced from the freezer chamber. In case that the water supply pipe is frozen, water in the water supply pipe may flow back to cause water leakage in the water supply apparatus.

DISCLOSURE

Technical Problem

The disclosure provides prevention of water leakage occurring in a water supply apparatus by allowing backflow water to be retrieved to a water tank in case that a backflow water phenomenon occurs in the water supply pipe.

Technical Solution

According to an embodiment in the disclosure, a refrigerator includes: an ice-making apparatus disposed in a freezer chamber and producing ice; a water tank disposed in a refrigerating chamber formed above the freezer chamber and storing water to be supplied to the ice-making apparatus; a water supply pipe connecting the water tank and the ice-making apparatus to each other to supply water in the water tank to the ice-making apparatus; a water supply pump disposed on the water supply pipe and moving water in the water tank to the ice-making apparatus; and a bypass pipe having one side diverging from the water supply pipe in the opposite direction of gravity, and the other side connected to the water tank for water flowing back in the water supply pipe to move to the water tank.

The one side of the bypass pipe may be formed to have a predetermined height with respect to the water supply pipe.

The bypass pipe may be formed to be inclined downward from the one side to the other side.

The other side of the bypass pipe may be disposed on an upper portion of the water tank for the inside and outside of the water supply pipe to communicate with each other.

The bypass pipe may be disposed above a maximum level of water stored in the water tank to supply air to the water supply pipe.

The bypass pipe may be disposed at the rear end of the water supply pump to prevent water flowing back in the water supply pipe from moving to the water supply pump.

The bypass pipe may be formed to have a diameter smaller than a diameter of the water supply pipe.

The bypass pipe includes a T-type coupler disposed in the water supply pipe, and a connection line connecting the T-type coupler and the water tank to each other.

The T-type coupler may include a first connection portion formed along the water supply pipe, and a second connection portion extending from the first connection portion in the opposite direction of the gravity.

The second connection portion may be formed to have a predetermined height.

The connection line may be formed to be inclined downward from the second connection portion toward the water tank.

The water supply pipe may be disposed to be inclined downward toward the ice-making apparatus.

Advantageous Effects

The water supply apparatus having the above structure according to an embodiment of the disclosure may include the bypass pipe diverging from the water supply pipe disposed between the water tank and the ice-making apparatus, thereby allowing the backflow water to be retrieved to the water tank when the water is blocked from flowing in the water supply pipe, and also preventing water from overflowing to the outside of the water supply apparatus.

BEST MODE

Mode

Hereinafter, embodiments of a water supply apparatus according to the disclosure and a refrigerator comprising the same are described in detail with reference to the accompanying drawings.

Embodiments described below are illustratively provided to assist in understanding of the disclosure, and it is to be understood that the disclosure may be variously modified and executed unlike the embodiments described herein. However, when it is decided that a detailed description for the known functions or components related to the disclosure may obscure the gist of the disclosure, the detailed description and concrete illustration will be omitted. Further, the accompanying drawings are not illustrated to scale, but sizes of some of components may be exaggerated to assist in the understanding of the disclosure.

Terms used in the specification, 'first', 'second', etc., may be used to describe various components, but the components are not to be interpreted to be limited to the terms. These terms may be used to differentiate one component from other components. For example, a 'first' component may be named a 'second' component and the 'second' component may also be similarly named the 'first' component, without departing from the scope of the disclosure.

Terms used in exemplary embodiments of the disclosure may be interpreted as the same meanings as meanings that are generally known to those skilled in the art unless defined otherwise.

In addition, terms such as 'fore end', 'rear end', 'upper portion', 'lower portion', 'upper end', 'lower end' and the like used in the disclosure are defined based on the drawings. The shapes and positions of respective components are not limited to these terms.

Figure 1:
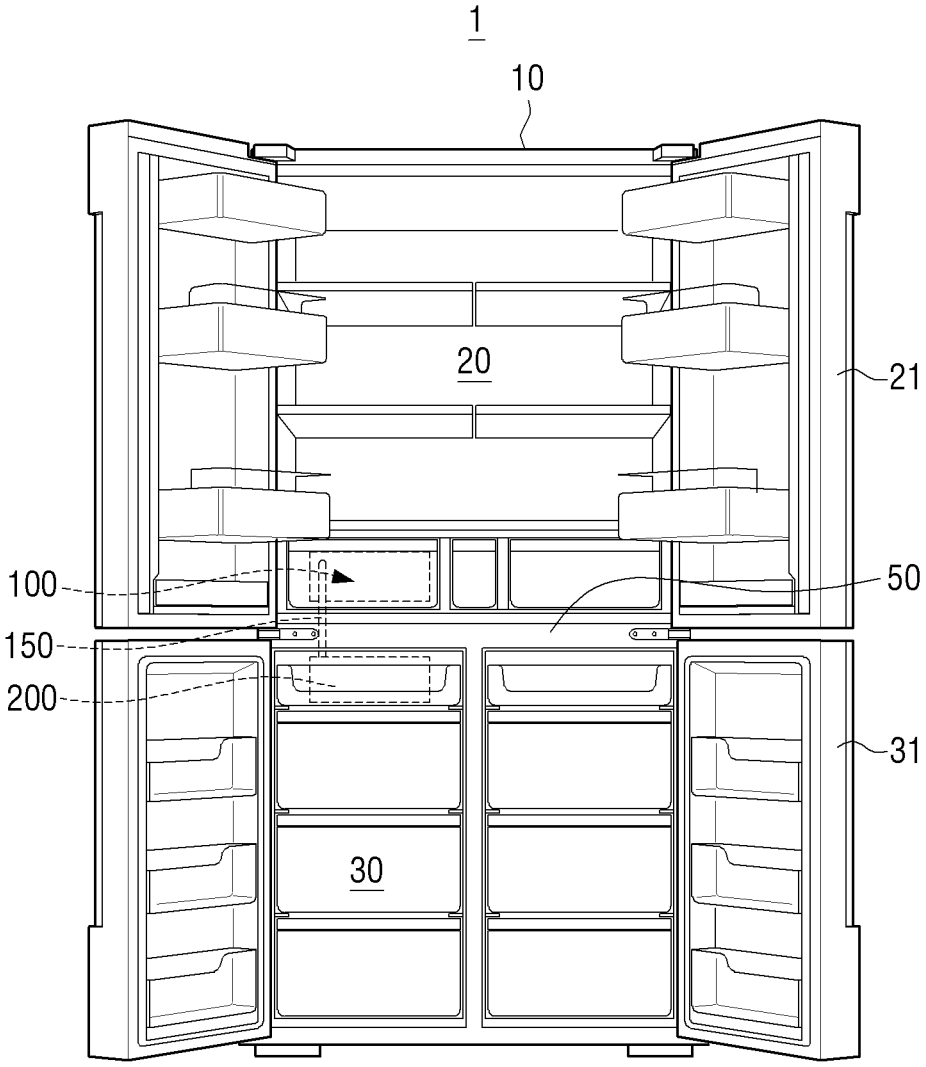
FIG. 1 is a schematic front view of a refrigerator including a water supply apparatus according to an embodiment of the disclosure.

FIG. 1 is a schematic front view of a refrigerator including a water supply apparatus according to an embodiment of the disclosure.

The refrigerator 1 includes a main body 10, storage spaces 20 and 30 respectively disposed in the main body 10, doors 21 and 31 respectively opening and closing the storage spaces 20 and 30, an ice-making apparatus 200 disposed in the freezer chamber 30 and producing ice, a water supply apparatus 100 disposed in a refrigerating chamber 20 and supplying water to the ice-making apparatus 200, and the refrigeration cycle that providing cold air.

Here, the description describes that the ice-making apparatus 200 is disposed in the freezer chamber 30. However, the refrigerator 1 is not limited thereto, and may include an ice making room (not shown) in which the ice-making apparatus 200 is disposed. The ice-making apparatus 200 installed in the ice making room may be disposed below the water supply apparatus 100. Such an ice making room may be disposed at a corner in the refrigerating chamber or may be disposed at the rear of the door of the refrigerating chamber.

Refrigerator 1 may have a T-shaped partition wall 50 formed in the main body 10 and including horizontal and vertical partition walls. The storage spaces 20 and 30 may be partitioned into upper and lower portions by a horizontal partition wall, and the refrigerating chamber 20 may thus be disposed at the upper portion of the main body 10, and the freezer chamber 30 may be disposed at the lower portion of the main body 1. In addition, the freezer chamber 30 may be partitioned into left and right spaces by the T-shaped partition wall 50.

At least one shelf may be disposed in the refrigerating chamber 20, and food may be placed thereon.

A pair of the doors 21 of the refrigerating chamber may open and close the open front of the refrigerating chamber 20. The pair of the doors 21 of the refrigerating chamber may be hinged to both sides of the main body 1, and may respectively be pivoted forward. Each door 21 of the refrigerating chamber may have a handle disposed on its front, and may open and close the door 21 of the refrigerating chamber 20.

A pair of the doors 31 of the freezer chamber may open and close the open front of the freezer chamber 30. The pair of the doors 31 of the freezer chamber may be hinged to both sides of the main body 1, and may respectively be pivoted forward. Each door 31 of the freezer chamber may have a handle disposed on its front, and may open and close the door 31 of the freezer chamber.

Meanwhile, the water supply apparatus 100 supplying water to the ice-making apparatus 200 may be disposed at a lower side of the refrigerating chamber 20.

The ice-making apparatus 200 producing and storing ice by receiving water from the water supply apparatus 100 may be disposed at an upper side of the freezer chamber 30.

A water supply pipe 150 of the water supply apparatus 100 may be connected to the ice-making apparatus 200, and may supply water from the water supply apparatus 100 to the ice-making apparatus 200.

FIG. 1 describes the T-type refrigerator having the T-shaped partition wall. However, the disclosure is not limited to this type, and may be applied to various types of refrigerators such as a so-called French door refrigerator (FDR) type refrigerator, in which a refrigerating chamber opened and closed by a pair of doors is disposed at its upper portion and a drawer-type freezer chamber is disposed at its lower portion, a bottom mounted freezer (BMF) type refrigerator and a 4-door refrigerator.

Figure 2:
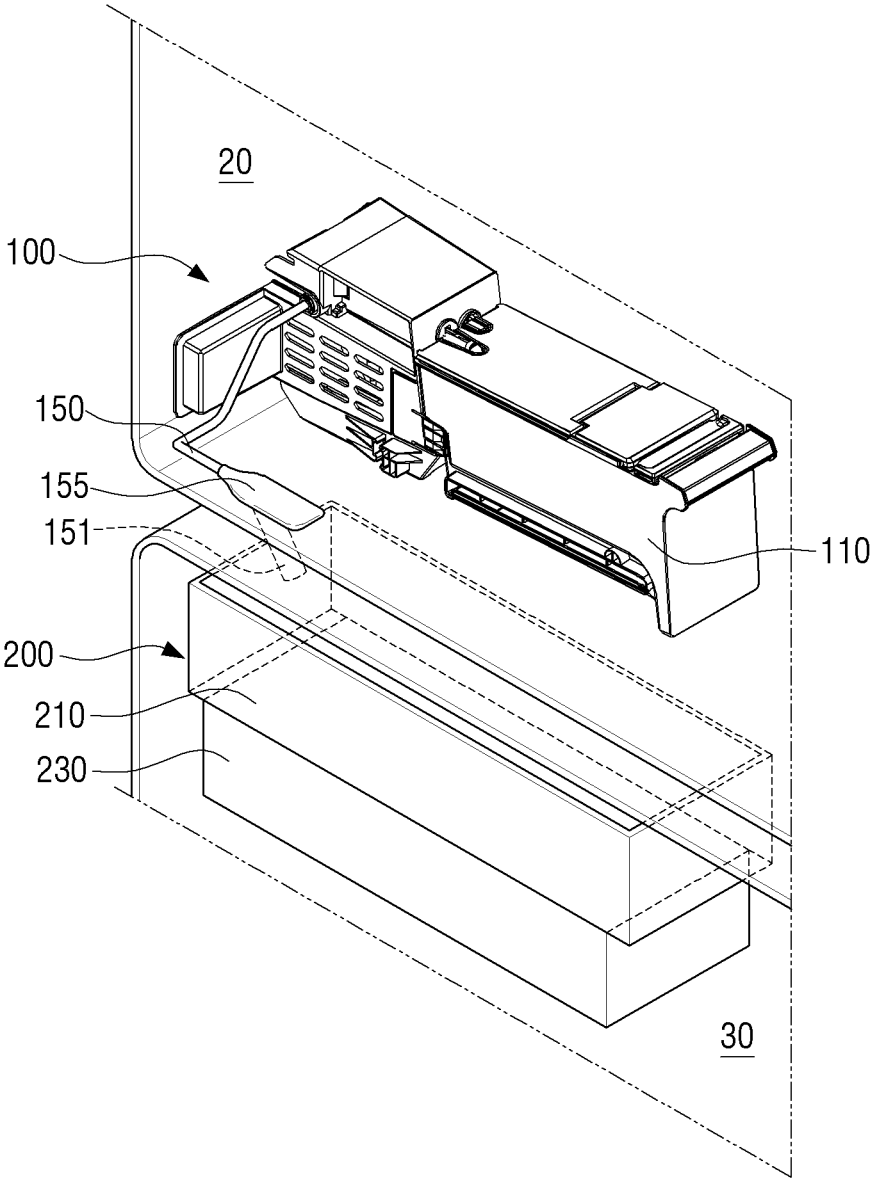
FIG. 2 is a partial perspective view of a refrigerator that shows the water supply apparatus and an ice-making apparatus according to an embodiment of the disclosure.
Figure 3:
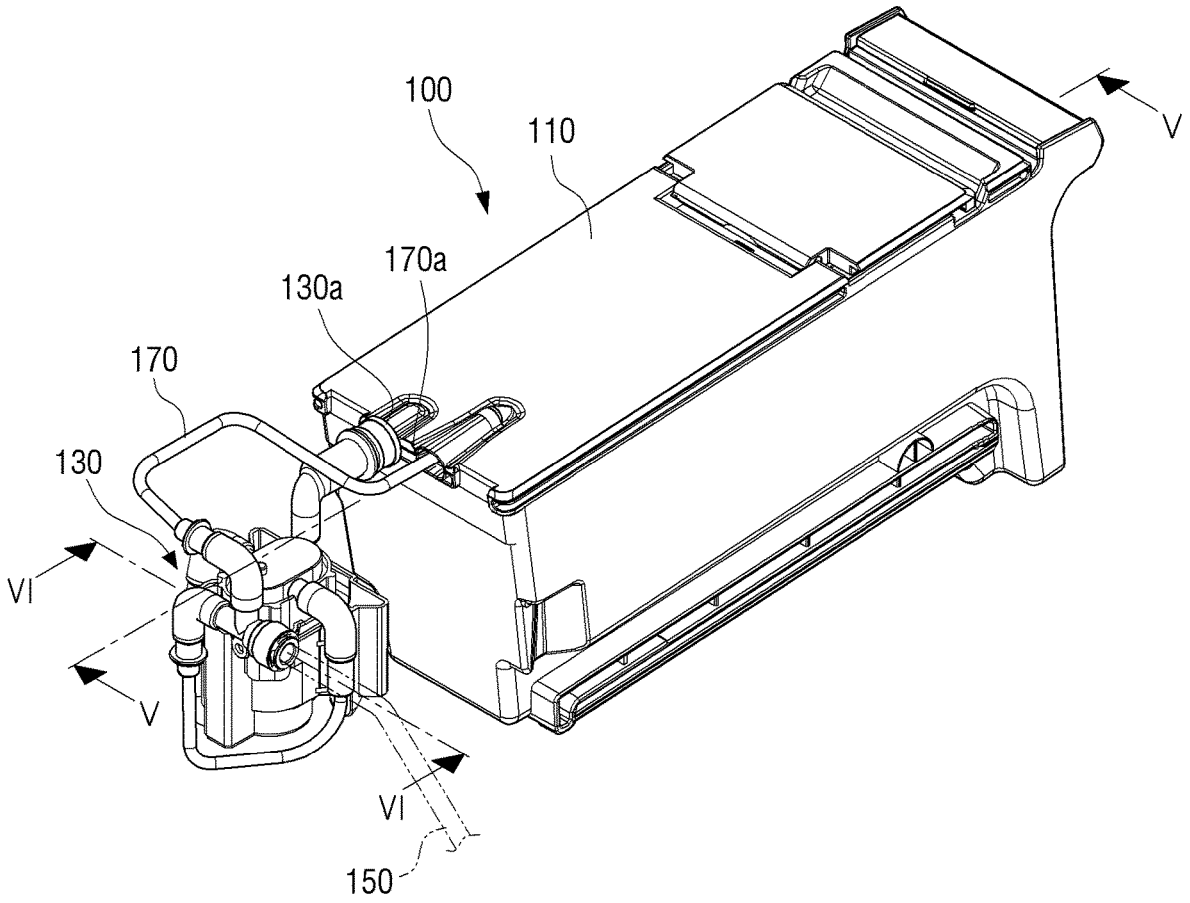
FIG. 3 is a perspective view of the water supply apparatus according to an embodiment of the disclosure.

FIG. 2 is a partial perspective view of a refrigerator that shows the water supply apparatus and the ice-making apparatus according to an embodiment of the disclosure; and FIG. 3 is a perspective view of the water supply apparatus according to an embodiment of the disclosure.

Referring to FIGS. 2 and 3, the water supply apparatus 100 may be disposed in the refrigerating chamber 20, and the ice-making apparatus 200 may be disposed in the freezer chamber 30 formed below the refrigerating chamber 20.

The water supply apparatus 100 may include a water tank 110, the water supply pipe 150 connecting the water tank 110 and the ice-making apparatus 200 to each other, and a water supply pump 130 and a bypass pipe 170 diverged from the water supply pump 130, and may thus supply water to the ice-making apparatus 200 which is described below.

The water tank 110 may store water to be supplied to the ice-making apparatus 200. The water tank 110 may be filled with a predetermined amount of water.

The water supply pipe 150 may be formed to have one end connected to the water tank 110 and the other end connected to the ice-making apparatus 200. Water stored in the water tank 110 may be supplied to the ice-making apparatus 200 through the water supply pipe 150.

One end 130*a* of the water supply pipe 150 may be connected to the water tank 110. The one end 130*a* of the water supply pipe 150, which transfers water from the water tank 110 to the ice-making apparatus 200, may be disposed to be spaced apart from one end 170*a* of the bypass pipe 170 which is described below.

The water supply pump 130 may be installed on the water supply pipe 150. The water supply pump 130 may pump water stored in the water tank 110 and supply water to the ice-making apparatus 200. The water supply pump 130 may be configured of a pump which may be rotated in one direction. In case that the water supply pump 130 is rotated, water stored in the water tank 110 may be supplied to the ice-making apparatus 200 along the water supply pipe 150 by suction power of the water supply pump 130.

That is, water stored in the water tank 110 may be supplied to the ice-making apparatus 200 by passing through the water supply pump 130 and the water supply pipe 150 in sequence.

If the water supply pump 130 is operated and water from the water tank 110 moves to the ice-making apparatus 200 through the water supply pipe 150, water provided to the ice-making apparatus 200 may be frozen in the ice-making apparatus 200 to be converted to ice.

Then, if the water supply pump 130 stops its operation, water in the water tank 110 may no longer move to the ice-making apparatus 200. Here, water that has yet to flow out of the pipe may remain at both the ends of the water supply pipe 150, and a vacuum pressure may be generated between the ends.

The bypass pipe 170 may guide water flowing back in the water supply pipe 150 to move to the water tank 110. The bypass pipe 170 may have one side diverging from the water supply pipe 150 in the opposite direction of gravity, and the other side connected to the water tank 110.

In case that water has yet to flow out of the water supply pipe 150 and remains therein, the water supply pipe 150 may be frozen by cold air introduced from the freezer chamber 30. In case that the water supply pipe 150 is frozen, water flowing back in the water supply pipe 150 may be retrieved into the water tank 110 along the bypass pipe 170.

In case that the water supply pipe 150 is frozen, water in the water supply pipe 150 may flow back, and water may thus leak from a relatively weak portion of the water supply pipe 150, around the water supply pump 130. The bypass pipe 170 may guide the water flowing back in the water supply pipe 150 to move back to the water tank 110, thereby preventing the water leakage in the water supply apparatus 100.

In addition, the bypass pipe 170 may be disposed to be exposed to the outside for the inside and outside of the water supply pipe 150 to communicate with each other. That is, the bypass pipe 170 may be formed to have the other side open to external air for the air to be introduced into the water supply pipe 150.

In detail, the other side 170*a* of the bypass pipe 170 may be formed to be connected to an upper portion of the water tank 110. The other side 170*a* of the bypass pipe 170 may be disposed above a maximum level of water stored in the water tank 110.

If water is supplied to the ice-making apparatus 200 by the water supply pump 130 and then the water supply pump 130 stops its operation, water may no longer move from the water tank 110 to the ice-making apparatus 200. Here, water that has yet to flow out of the pipe may remain at both the ends of the water supply pipe 150, and the vacuum pressure may be generated between the ends. As the vacuum pressure is generated in the water supply pipe 150, water in the water tank 110 cannot continue to move to the ice-making apparatus 200.

In this case, as the present disclosure has the bypass pipe 170 diverging from the water supply pipe 150, it is possible to prevent such a vacuum pressure from being generated between both the ends of the water supply pipe 150 due to air injected from the bypass pipe 170. Accordingly, water head difference in the water supply pipe 150 may be maintained based on a height difference between the water tank 110 and the ice-making apparatus 200.

In addition, the bypass pipe 170 may provide air to the water supply pipe 150, and may thus prevent water from remaining in the water supply pipe 150 in case that water supply is stopped.

The ice-making apparatus 200 receiving water from the water supply apparatus 100 may be disposed in a lower position than the water supply apparatus 100. In detail, an ice-making tray 210 of the ice-making apparatus 200 receiving water may be disposed at the lower position than the water tank 110 of the water supply apparatus 100.

The ice-making apparatus 200 may include the ice-making tray 210 and an ice storage 230 storing produced ice.

The ice-making tray 210 is a bowl in which ice is produced, and may be formed to have an open upper surface for the water supplied from the water tank 110 to be supplied thereto.

A water supply 151 of the water supply pipe 150 may be disposed at one side of the ice-making tray 210, and may supply water to the ice-making tray 210.

A refrigerant pipe may be disposed at a lower portion of the ice-making tray 210 while being in contact therewith. The ice-making tray 210 may include an ejector (not shown) pushing out ice produced from the ice-making tray 210 and discharging the ice from the ice-making tray 210.

The ice storage 230 may have a shape of a box having an open upper surface to store ice discharged from the ice-making tray 210 by the ejector, and may be disposed below the ice-making tray 210.

Figure 4:
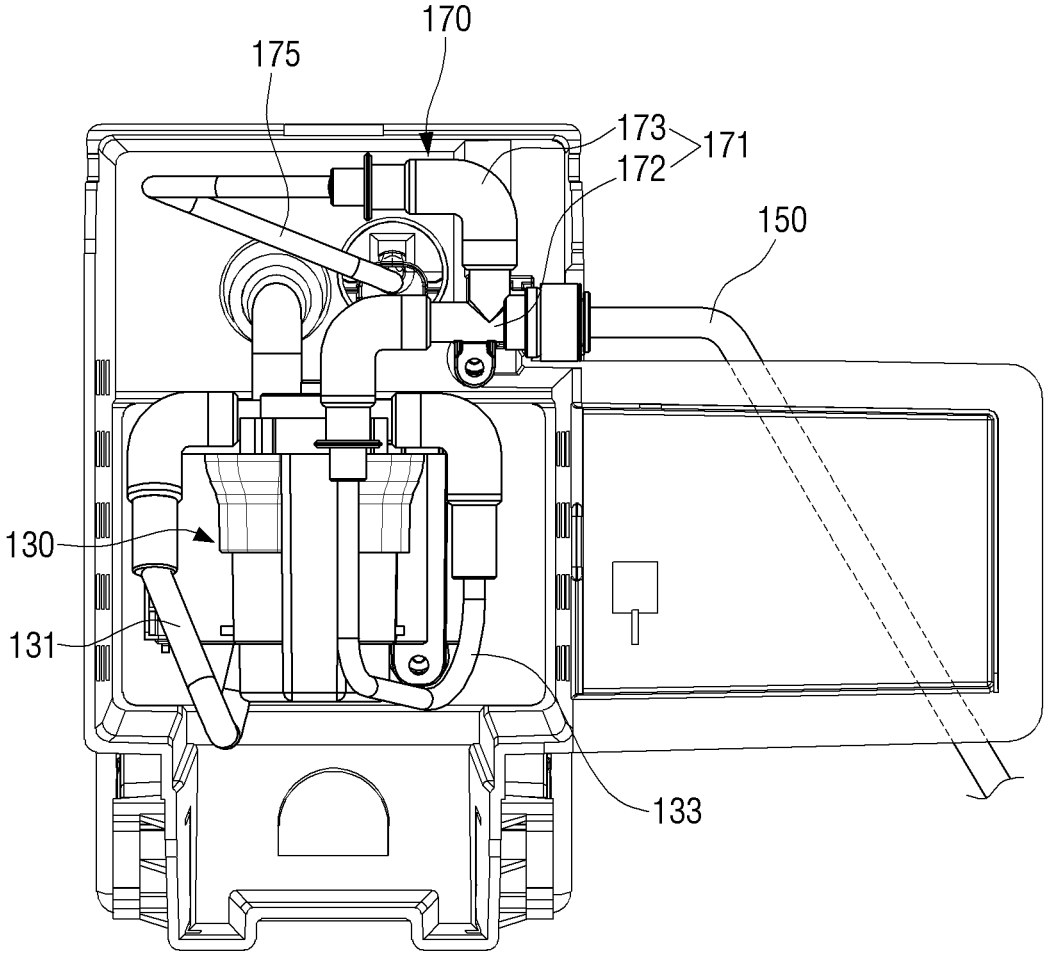
FIG. 4 is a side view of the water supply apparatus according to an embodiment of the disclosure.

FIG. 4 is a side view of the water supply apparatus according to an embodiment of the disclosure.

Referring to FIG. 4, the water supply pipe 150 may include a first flow path 131 through which water discharged from the water tank 110 is introduced to the water supply pump 130 and a second flow path 133 through which water is discharged from the water supply pump 130.

Water stored in the water tank 110 may move to the water supply pump 130 along the first flow path 131 by the suction power of the water supply pump 130, and water passed through the water supply pump 130 may be supplied to the ice-making apparatus 200 along the second flow path 133.

The second flow path 133 and the water supply pipe 150 may be connected to each other, and may be formed integrally with each other.

The bypass pipe 170 may be formed between the second flow path 133 and the water supply pipe 150. The bypass pipe 170 may be disposed at the rear end of the water supply pump 130 to prevent water flowing back in the water supply pipe 150 from moving to the water supply pump 130.

The bypass pipe 170 may be formed to diverge from the water supply pipe 150 in the opposite direction of the gravity.

The bypass pipe 170 may include a T-type coupler 171 disposed in the water supply pipe 150, and a connection line 175 connecting the T-type coupler 171 and the water tank 110 to each other.

The T-type coupler 171 may include a first connection portion 172 formed along the water supply pipe 150 and a second connection portion 173 extending vertically from the first connection portion 172.

The first connection portion 172 may be formed horizontally with respect to a portion of the water supply pipe 150, and the second connection portion 173 may be formed vertically with respect to the first connection portion 172 and may have a predetermined height.

The second connection portion 173 may be formed perpendicular to a portion of the water supply pipe 150, and may communicate with the first connection portion 172. The second connection portion 173 may extend from the first connection portion 172 in the opposite direction of the gravity. A point where the second connection portion 173 and the first connection portion 172 meet with each other may correspond to a diverging point of the T-type coupler 171.

The first connection portion 172 and the second connection portion 173 may be formed integrally with each other.

The second connection portion 173 may have one end communicating with the first connection portion 172, and may have the other end at which the connection line 175 is disposed. Water overflowing from the second connection portion 173 having the predetermined height may be discharged to the water tank 110 along the connection line 175.

The connection line 175 may be formed from the T-type coupler 171 to be inclined downward toward the water tank 110. Water introduced to the connection line 175 may be discharged to the water tank 110 by the gravity.

The bypass pipe 170 may be formed to have the predetermined height with respect to the water supply pipe 150. Accordingly, in case that the water supply pump 130 is operated, the water moving along the second flow path 133 may not move to the bypass pipe 170, and may move to the ice-making apparatus 200 along the water supply pipe 150.

Meanwhile, in a process in which a large amount of water moves by the water supply pump 130, the water supply pipe 150 may be frozen, and the other side of the water supply pipe 150 (its region adjacent to the ice-making apparatus) may thus be blocked. In this case, water may fill the water supply pipe 150 and the second flow path 133. Here, the water filling the water supply pipe 150 and the second flow path 133 may overflow to the second connection portion 173 of the bypass pipe 170 and may move along the bypass pipe 170. That is, in case that the water supply pipe 150 is frozen and water flows back, the backflow water may move to the water tank 110 by the bypass pipe 170.

In case that a backflow water phenomenon occurs in the water supply pipe 150, the backflow water may move to the bypass pipe 170 diverged upward from the water supply pipe 150. Accordingly, it is thus possible to prevent water from leaking from the water supply pipe 150 to the outside of the water supply apparatus 100.

The water flowing back in the water supply pipe 150 may not move to the water supply pump 130, and may be retrieved to the water tank 110 at the diverging point of the T-type coupler 171.

Figure 5:
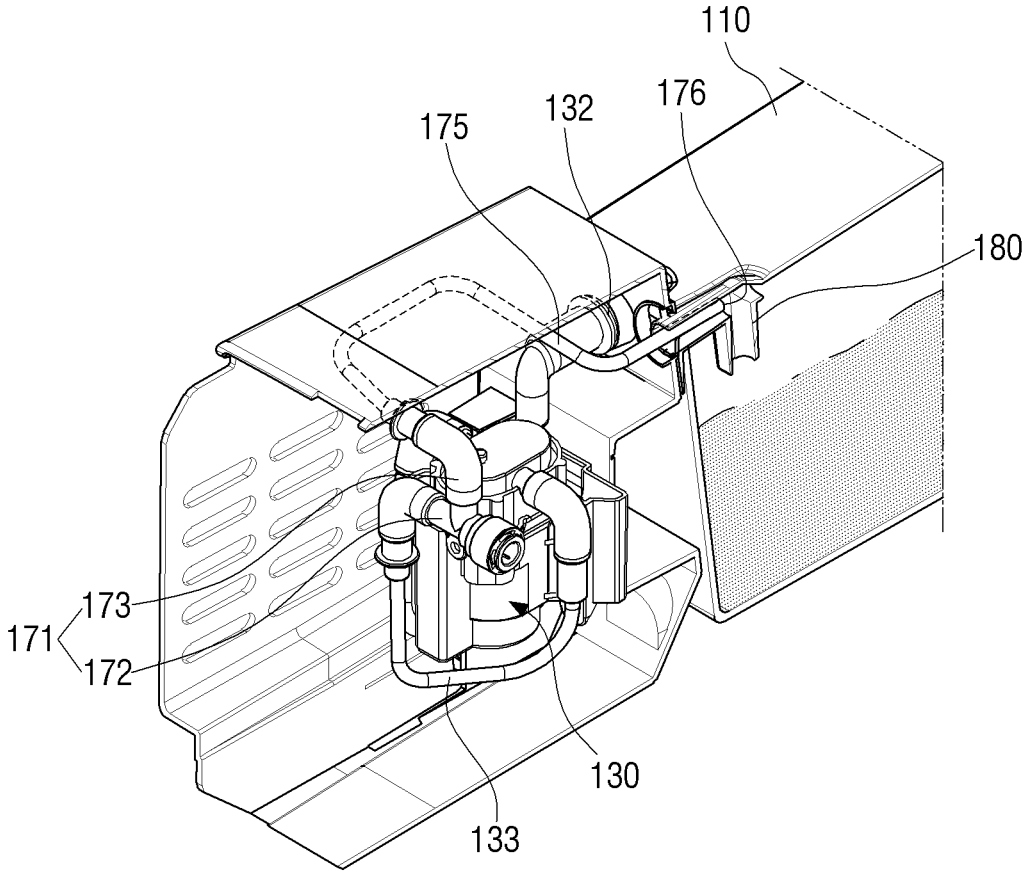
FIG. 5 is a cross-sectional view taken along "V-V" shown in FIG. 3.

FIG. 5 is a cross-sectional view taken along "V-V" shown in FIG. 3.

Referring to FIG. 5, the bypass pipe 170 may be disposed on the upper portion of the water tank 110. The bypass pipe 170 may include an air opening 176 supplying air to the water supply pipe 150.

The air opening 176 may be formed in the other side of the bypass pipe 170.

The air opening 176 may be disposed above the maximum level of water stored in the water tank 110. The air opening 176 may be disposed to be exposed to the outside to supply air to the water supply pipe 150. That is, the air opening 176 may be disposed in the upper portion of the water tank 110 where water does not reach.

The air opening 176 may be disposed above the maximum level of water stored in the water tank 110. Accordingly, water may not be supplied to the bypass pipe 170 if the water supply pump 130 is operated, and air may be introduced to the bypass pipe 170 if the water supply pump 130 stops its operation.

External air may be introduced into the water supply pipe 150 through the air opening 176.

It is possible to prevent the vacuum pressure from being generated in the water supply pipe 150 and to prevent water from staying in the pipe by forming the bypass pipe 170 including the air opening 176 exposed to air.

The water supply pipe 150 may communicate with the bypass pipe 170 including the air opening 176. An atmospheric pressure may be applied to the water supply pipe 150 through the bypass pipe 170 including the air opening 176, and accordingly, water may not stay in the water supply pipe 150 due to the pressure caused by the water head difference in the water supply pipe 150.

In addition, if water is supplied to the ice-making apparatus 200 by the water supply pump 130, and then the water supply pump 130 stops its operation, water that has yet to flow out of the water supply pipe 150 may remain at both the ends of the pipe. Here, air may be introduced to the water supply pipe 150 through the air opening 176 of the bypass pipe 170 to discharge water remaining in the water supply pipe 150.

As water remaining in the water supply pipe 150 is discharged, it is possible to solve the problem in which water remains in the pipe due to the water head difference in the water supply pipe 150. It is also possible to drain water remaining in the water supply pipe 150, and may thus reduce a possibility in which the water supply pipe 150 is frozen.

Meanwhile, among the sides of the water supply pipe 150, the other side of the water supply pipe 150, which is adjacent to the ice-making apparatus 200, may be frozen, and water in the water supply pipe 150 may thus flow back. Even in this case, backflow water may be retrieved to the water tank 110 along the bypass pipe 170.

In case that one side of the water supply pipe 150 is blocked by freezing or the like, water discharged from the water supply pump 130 may fill the T-type coupler 171, and water filling the T-type coupler 171 may move to the connection line 175. In detail, water may fill up to an upper portion of the first connection portion 172 and may fill up to the second connection portion 173 connected to the first connection portion 172. Water overflowing from the second connection portion 173 may move to the water tank 110 along the connection line 175.

The connection line 175 may be disposed to be inclined downward toward the water tank 110. Water introduced to the connection line 175 may move to the water tank 110 by the gravity.

A guide portion 180 guiding water discharged from the connection line 175 to be discharged to the water tank 110 may be disposed at the other side of the connection line 175.

The guide portion 180 may be formed to surround the air opening 176 of the connection line 175 to prevent the air opening 176 from being blocked by water or a foreign material. A portion of the connection line 175 may be disposed inside the guide portion 180.

The guide portion 180 may be formed to be spaced apart from the air opening 176 by a predetermined distance.

The guide portion 180 may protrude downward to guide water discharged from the air opening 176 to move downward.

In case that the other side of the water supply pipe 150 is blocked by freezing or the like of the water supply pipe 150, the bypass pipe 170 may guide water flowing back in the water supply pipe 150 to move back to the water tank 110, thereby preventing water leakage from occurring in the water supply apparatus 100.

Figure 6:
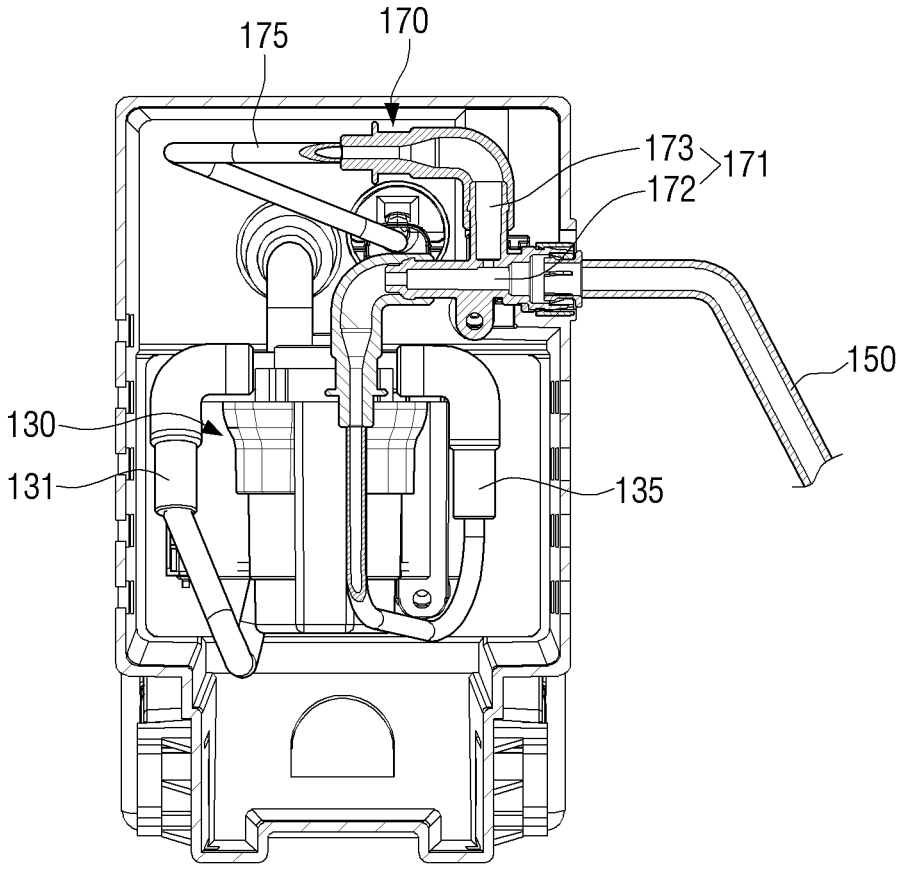
FIG. 6 is a cross-sectional view taken along "VI-VI" shown in FIG. 3.

FIG. 6 is a cross-sectional view taken along "VI-VI" shown in FIG. 3.

Referring to FIG. 6, the bypass pipe 170 may be formed to have a diameter smaller than a diameter of the water supply pipe 150. The bypass pipe 170 may be formed to have the diameter smaller than the water supply pipe 150 to prevent water supplied to the ice-making apparatus 200 from spilling through the bypass pipe 170 in the process in which a large amount of water moves by the water supply pump 130.

In detail, the second connection portion 173 of the bypass pipe 170, which is formed to have the predetermined height, may have a diameter smaller than the water supply pipe 150.

To produce ice, the water supply pump 130 may supply water from the water tank 110 to the ice-making apparatus 200. If the water supply pump 130 stops its operation after a predetermined period of the operation, air may be introduced to the water supply pipe 150 through the bypass pipe 170. The introduced air may discharge water remaining in the water supply pipe 150 to the ice-making apparatus 200.

If all water remaining in the water supply pipe 150 is discharged to the ice-making apparatus 200, it is possible to prevent water from remaining in the water supply pipe 150.

In addition, the bypass pipe 170 may be disposed at a position above the maximum level of water stored in the water tank 110. Accordingly, water may not move from the bypass pipe 170 to the water supply pipe 150 when the water supply pump 130 is operated to supply water to the ice-making apparatus 200, and air may be introduced from the bypass pipe 170 to the water supply pipe 150 when the water supply pump 130 stops its operation. It is possible to discharge all water remaining in the water supply pipe 150 by the introduced air, thereby preventing water from remaining in the pipe to obstruct a water flow, in advance.

In addition, the bypass pipe 170 may diverge from the water supply pipe 150 in the opposite direction of the gravity. Accordingly, if the backflow water phenomenon occurs in the water supply pipe 150, the backflow water may be retrieved to the water tank 110 along the diverging bypass pipe 170, thereby preventing the water leakage from occurring in the water supply apparatus 100.

Hereinabove, the disclosure is described as an illustrative method. It is to be understood that terms used herein are provided to describe the disclosure rather than limiting the disclosure. Various modifications and alternations of the disclosure may be made according to the contents described above. Therefore, the disclosure may be freely practiced without departing from the scope of the claims unless additionally mentioned.

The invention claimed is:

1. A refrigerator comprising:

an ice-making apparatus disposed in a freezer chamber and configured to produce ice;

a water tank disposed in a refrigerating chamber formed above the freezer chamber and configured to store water to be supplied to the ice-making apparatus;

a water supply pipe connecting the water tank and the ice-making apparatus to each other to supply water in the water tank to the ice-making apparatus;

a water supply pump disposed on the water supply pipe and configured to move water in the water tank to the ice-making apparatus; and a bypass pipe having one side diverging from the water supply pipe in an opposite direction of gravity, and an other side that longitudinally extends horizontally along an upper portion of the water tank above a maximum water level in the water tank and that has an end that is open for water flowing back in the water supply pipe to move therethrough to the water tank and for external air to be introduced into the water supply pipe, wherein the water tank includes a guide portion disposed on an upper portion of the water tank, wherein the guide portion has one end longitudinally extending horizontally and surrounding the other side of the bypass pipe, spaced apart from an outer circumference of the other side of the bypass pipe, and another end protruding downward from the one end, so that the guide portion surrounds the end of the other side of the bypass pipe that is open, wherein the bypass pipe includes a T-type coupler disposed in the water supply pipe and includes a first connection portion formed along the water supply pipe and a second connection portion extending from the first connection portion in the opposite direction of the gravity, wherein the bypass pipe is above the water supply pipe, and wherein the second connection portion of the bypass pipe has a diameter smaller than the water supply pipe.

2. The refrigerator as claimed in claim 1, wherein the bypass pipe is inclined downward from the one side to the other side.

3. The refrigerator as claimed in claim 1, wherein the bypass pipe is disposed at a rear end of the water supply pump to prevent water flowing back in the water supply pipe from moving to the water supply pump.

4. The refrigerator as claimed in claim 1, wherein the bypass pipe has a diameter smaller than a diameter of the water supply pipe.

5. The refrigerator as claimed in claim 1, wherein the bypass pipe includes a connection line connecting the T-type coupler and the water tank to each other.

6. The refrigerator as claimed in claim 5, wherein the connection line is inclined downward from the second connection portion toward the water tank.

7. The refrigerator as claimed in claim 1, wherein the water supply pipe is inclined downward toward the ice-making apparatus.

* * * * *